US005533368A

United States Patent [19]

Eagan

[11] Patent Number: 5,533,368

[45] Date of Patent: Jul. 9, 1996

[54] MEANS FOR, AND A METHOD OF, ADJUSTING A CYLINDRICAL LOCKSET FOR DOOR THICKNESS-SIZING

[75] Inventor: Bruce P. Eagan, Colorado Springs, Colo.

[73] Assignee: Schlage Lock Company, San Francisco, Calif.

[21] Appl. No.: 399,252

[22] Filed: Mar. 6, 1995

[51] Int. Cl.[6] ..... E05B 9/04

[52] U.S. Cl. ..... 70/374; 70/461; 33/194

[58] Field of Search ..... 70/374, 461; 292/DIG. 60; 33/194, 539, 626, 636, 638

[56] References Cited

U.S. PATENT DOCUMENTS

| | | | |
|---|---|---|---|
| 897,685 | 9/1908 | Voight . | |
| 904,580 | 11/1908 | Voight | 70/374 |
| 997,429 | 7/1911 | Voight | 70/374 |
| 1,008,533 | 11/1911 | Fletcher | 70/374 |
| 1,011,286 | 12/1911 | Voight . | |
| 1,042,297 | 10/1912 | Voight . | |
| 1,766,081 | 6/1930 | Munch | 70/374 |
| 2,207,878 | 7/1940 | Schlage . | |
| 2,886,689 | 5/1959 | Kushion | 33/636 |
| 3,276,232 | 10/1966 | Bourgeois | 70/370 |

FOREIGN PATENT DOCUMENTS

| | | | |
|---|---|---|---|
| 366680 | 1/1922 | Germany | 70/374 |

*Primary Examiner*—Darnell M. Boucher
*Attorney, Agent, or Firm*—Bernard J. Murphy; Robert F. Palermo

[57] ABSTRACT

The limbs of the spring cage overlie portions of the cylindrical lock chassis. Accordingly, a graduated scale, with Arabic numerals aligned therewith, is inscribed on a portion of the chassis which one of the limbs overlies, and the flat, terminal end of the limb is used to indicate a proper door thickness adjustment. The cage is spring-biased away from the chassis, and retained on a projecting shaft by an adjusting nut threadedly engaged with the shaft. By threadedly moving the nut on the shaft, the cage is moved relative to the shaft and concomitantly, the limb terminal end is selectively aligned with a chosen one of the door thickness-indicating scale lines.

5 Claims, 1 Drawing Sheet

MEANS FOR, AND A METHOD OF, ADJUSTING A CYLINDRICAL LOCKSET FOR DOOR THICKNESS-SIZING

BACKGROUND OF THE INVENTION

This invention pertains to cylindrical locksets, generally, and in particular to the installation of such locksets in doors of varying thicknesses.

The typical cylindrical lockset has a cylindrical lock chassis, and whatever the thickness of the door in which the lockset is to be installed, the transverse centerline of the chassis must coincide with the centerline of the door thickness. If this installation criterion is not met, the lockset may well fail to function properly.

No practical means are known which will accurately adjust a cylindrical lockset for a door thickness-sizing, neither is there any known method of addressing the problem. The adjustment of the lockset must be done by the inefficient method of trial and error, the same being time-consuming and lacking precision.

What has long been needed, then, is just such a facile means for adjusting a cylindrical lockset for door thickness-sizing, and a method which sets out the steps of so adjusting a cylindrical lockset for correct door thickness-sizing, in order that installation can be undertaken with precision and dispatch.

SUMMARY OF THE INVENTION

In view of the aforecited, long unmet need, it is a purpose of this invention to disclose means for adjusting a cylindrical lockset for door thickness-sizing, comprising a cylindrical lock chassis; an apertured, spring cage; a threaded shaft (a) extending from said chassis, and (b) in penetration of said cage; means interposed between said chassis and said cage for urging said cage outwardly from said chassis; and an adjustment nut (a) threadedly engaged with said shaft, and (b) confrontingly engaging said cage and retaining said cage on said shaft; wherein said cage has a limb extending therefrom and overlying a given portion of said chassis; and further including door thickness-sizing indicia on said given portion of said chassis; and wherein said limb has means for alignment thereof, depending upon a selectively-adjusted positioning of said nut on said shaft, with differing ones of said indicia.

Too, it is a purpose of this invention to set forth a method of adjusting a cylindrical lockset for door thickness-sizing, wherein the lockset has (1) a cylindrical lock chassis, (2) an apertured, spring cage, (3) a threaded shaft (a) extending from said chassis, and (b) in penetration of said cage, (4) means interposed between said chassis and said cage for urging said cage outwardly from said chassis, and (5) an adjustment nut (a) threadedly engaged with said shaft, and (b) confrontingly engaging said cage and retaining said cage on said shaft, and wherein said cage has a limb extending therefrom and overlying a given portion of said chassis, the method comprises the steps of inscribing door thickness-sizing indicia on said given portion of said chassis; and threadedly adjusting a positioning of said nut on said shaft so as to (a) move said cage relative to said shaft, and (b) concomitantly, align a terminal end of said limb with a selected one of said indicia.

The aforesaid, and further purposes of this invention, will become apparent by reference to the following description taken in conjunction with the accompanying drawing.

DESCRIPTION OF THE DRAWING

The figure is a plan view of a cylindrical lockset which incorporates the invention, according to an embodiment thereof, and enables a practice of the novel method, the same showing the spring cage cut away, or cross-sectioned, for the purpose of clarity of disclosure.

BRIEF DESCRIPTION OF THE PREFERRED EMBODIMENT

Figure 1:
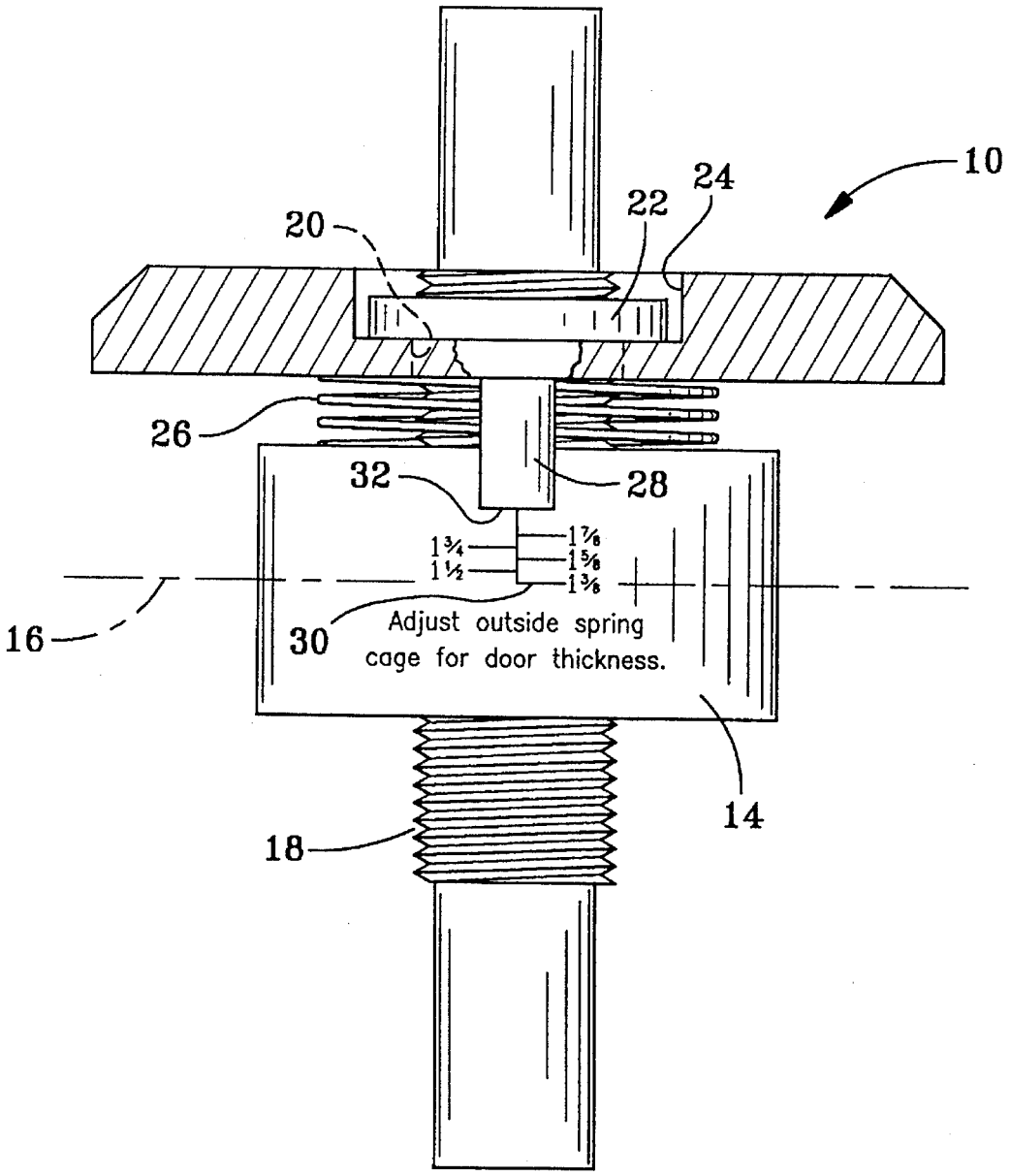

The figure is a plan view of a cylindrical lockset 10 in which a portion thereof, i.e., the spring cage 12, is shown in cross-section. A cylindrical lock chassis 14 has a transverse centerline 16 which, for proper installation of the lockset 10 in a door, must coincide with the centerline of the thickness of the subject door. A threaded shaft 18 extends from the chassis 14 out opposite ends thereof. The spring cage 12 has an unthreaded aperture 20 formed therein, and the shaft 18 penetrates the aperture 20. An adjusting nut 22 is threadedly engaged with the through-aperture portion of the shaft 18. The adjustment nut 22 is received in a recess 24 formed therefor in the cage 12. A compression spring 26 is interposed between the cage 12 and the chassis 14, for urging the cage outwardly from the chassis 14 and against the nut 22. The cage 12 has a pair of projecting limbs 28 (only one thereof being shown) on opposite sides thereof. Each limb 28 overlies a portion of the outer surface of the chassis 14.

According to the invention, the portion of the surface of the chassis 14 which one limb 28 overlies, has an adjustment, graduated scale 30 inscribed thereon, the same having Arabic numerals aligned therewith to signify what the lines of the scale 30 indicate, namely: door thicknesses. The flat, terminal end 32 of the limb 28 has only to be aligned with a selected one of the scale lines, to set the lockset 10 properly for a door of the indicated thickness. To do so, one has only to turn the adjustment nut 22 in one direction or the other to move the cage 12 relative to the shaft 18 and, concomitantly, the scale-indicating end 32 of the limb 28.

While I have described my invention in connection with a specific embodiment thereof it is to be clearly understood that this is done only by way of example, and not as a limitation to the scope of the invention as set forth in the purposes thereof and in the appended claims.

What is claimed is:

1. Means for adjusting a cylindrical lockset for door thickness-sizing, comprising:

a cylindrical lock chassis;

an apertured, spring cage;

a threaded shaft (a) extending from said chassis, and (b) in penetration of said cage;

means interposed between said chassis and said cage for urging said cage outwardly from said chassis; and an adjustment nut (a) threadedly engaged with said shaft, and (b) confrontingly engaging said cage and retaining said cage on said shaft; wherein said cage has a limb extending therefrom and overlying a given portion of said chassis; and further including door thickness-sizing indicia on said give portion of said chassis; and wherein said limb has means for alignment thereof, depending upon a selectively-adjusted positioning of said nut on said shaft, with differing ones of said indicia.

2. Means for adjusting a cylindrical lockset for door thickness-sizing, according to claim 1, wherein:

said indicia comprises a graduated scale; and said alignment means comprises a terminal end of said limb.

3. A method of adjusting a cylindrical lockset for door thickness-sizing, wherein the lockset has (1) a cylindrical lock chassis, (2) an apertured, spring cage, (3) a threaded shaft (a) extending from said chassis, and (b) in penetration of said cage, (4) means interposed between said chassis and said cage for urging said cage outwardly from said chassis, and (5) an adjustment nut (a) threadedly engaged with said shaft, and (b) confrontingly engaging said cage and retaining said cage on said shaft, and wherein said cage has a limb extending therefrom and overlying a given portion of said chassis, the method comprises the steps of:

inscribing door thickness-sizing indicia on said given portion of said chassis; and threadedly adjusting a positioning of said nut on said shaft so as to (a) move said cage relative to said shaft, and (b) concomitantly, align a terminal end of said limb with a selected one of said indicia.

4. A method, according to claim 3, wherein:

said indicia inscribing step comprises inscribing a graduated scale on said given portion of said chassis.

5. A method, according to claim 3, wherein:

said indicia inscribing step comprises inscribing Arabic numerals on said given portion of said chassis.

* * * * *